US011037535B2

(12) United States Patent
Steinberger

(10) Patent No.: US 11,037,535 B2
(45) Date of Patent: Jun. 15, 2021

(54) LOW FRICTION TUNER

(71) Applicant: Richard Ned Steinberger, Nobleboro, ME (US)

(72) Inventor: Richard Ned Steinberger, Nobleboro, ME (US)

( * ) Notice: Subject to any disclaimer, the term of this patent is extended or adjusted under 35 U.S.C. 154(b) by 0 days.

(21) Appl. No.: 16/740,558

(22) Filed: Jan. 13, 2020

(65) Prior Publication Data

US 2020/0227011 A1 Jul. 16, 2020

Related U.S. Application Data

(60) Provisional application No. 62/792,439, filed on Jan. 15, 2019.

(51) Int. Cl.
*G10D 3/14* (2020.01)
*G10D 3/12* (2020.01)

(52) U.S. Cl.
CPC ..... *G10D 3/14* (2013.01); *G10D 3/12* (2013.01)

(58) Field of Classification Search
CPC ..... G10D 3/14; G10D 3/12
USPC ..... 84/297 R
See application file for complete search history.

(56) References Cited

U.S. PATENT DOCUMENTS

| | | | | |
|---|---|---|---|---|
| 2,603,119 | A * | 7/1952 | Dearth | G10D 3/147 84/312 R |
| 4,366,740 | A * | 1/1983 | Tripp | G10D 3/04 84/197 |
| 7,279,626 | B2 * | 10/2007 | Draper | G10C 3/04 84/298 |
| 7,332,662 | B2 * | 2/2008 | Kandrack | G10D 1/085 84/293 |
| 10,923,086 | B2 * | 2/2021 | Hackett | G10D 1/085 |
| 2005/0150350 | A1 * | 7/2005 | Ramsay | G10D 3/153 84/313 |

* cited by examiner

*Primary Examiner* — Jianchun Qin
(74) *Attorney, Agent, or Firm* — Law Offices of Daniel A. Tesler, LLC

(57) ABSTRACT

A low friction tuner for use on stringed musical instruments is described in this application. The low friction tuner transfers the force of string tension from an area between the shoulder of the tuning knob and the tuner housing to a an area between a pointed tuning screw and bearing carrier, reducing the amount of force needed to turn the tuning knob when the string is under tension.

11 Claims, 4 Drawing Sheets

LOW FRICTION TUNER

CROSS REFERENCE TO RELATED APPLICATIONS

This application claims the benefit of U.S. Provisional Patent Application No. 62/792,439 filed Jan. 15, 2019, which is hereby incorporated by reference in its entirety.

FIELD

The present disclosure relates to tuners used on guitars and other stringed musical instruments.

BACKGROUND

Guitars and other stringed musical instruments use a tuner to adjust the tension of each string, thereby adjusting the pitch. On headless guitars, the tuner is mounted to the body of the instrument rather than the head. A common type of tuner used on headless guitars uses a knob fixed to a threaded rod, where the shoulder of the knob presses against a fixed housing and the threaded rod changes the position of a string carrier to adjust the tension on the string. In the prior art tuner, the string tension pulls the shoulder of the knob against the housing, creating a large amount of friction and making it difficult to turn the knob. Some designs in the prior art use a washer between the knob and the housing, which can reduce the amount of friction, but the knob still becomes difficult to turn when the string is under tension.

Therefore, a purpose of the present disclosure is to provide a low friction tuner that is easy to tune when the string is under tension.

BRIEF SUMMARY

The present disclosure includes a low friction tuner for a guitar or other stringed musical instrument. Relevant drawings are included with this disclosure.

DETAILED DESCRIPTION

The present disclosure relates to a musical string instrument tuner that utilizes a point bearing to minimize rotational friction.

In conventional tuners for headless guitars, the tuning knob functions like the head of a screw and bears the full tension of the string. Due to the relatively large diameter of the knob (and washer if used), the tension of the string causes enough friction between the tuning knob as the body of the conventional tuner to make it difficult to turn the tuning knob. Tuners for stringed musical instruments must be placed precisely at the appropriate string spacing for that instrument, which often places the tuning knobs very close together and limits their overall diameter. Due to the limited amount of space between strings, larger tuning knobs to increase leverage cannot be used in most situations, making friction a significant consideration in tuners.

This disclosure greatly reduces the friction felt at the tuning knob by adjusting the geometry of the tuner so that the tip of the screw bears the tension of the string.

Figure 1:
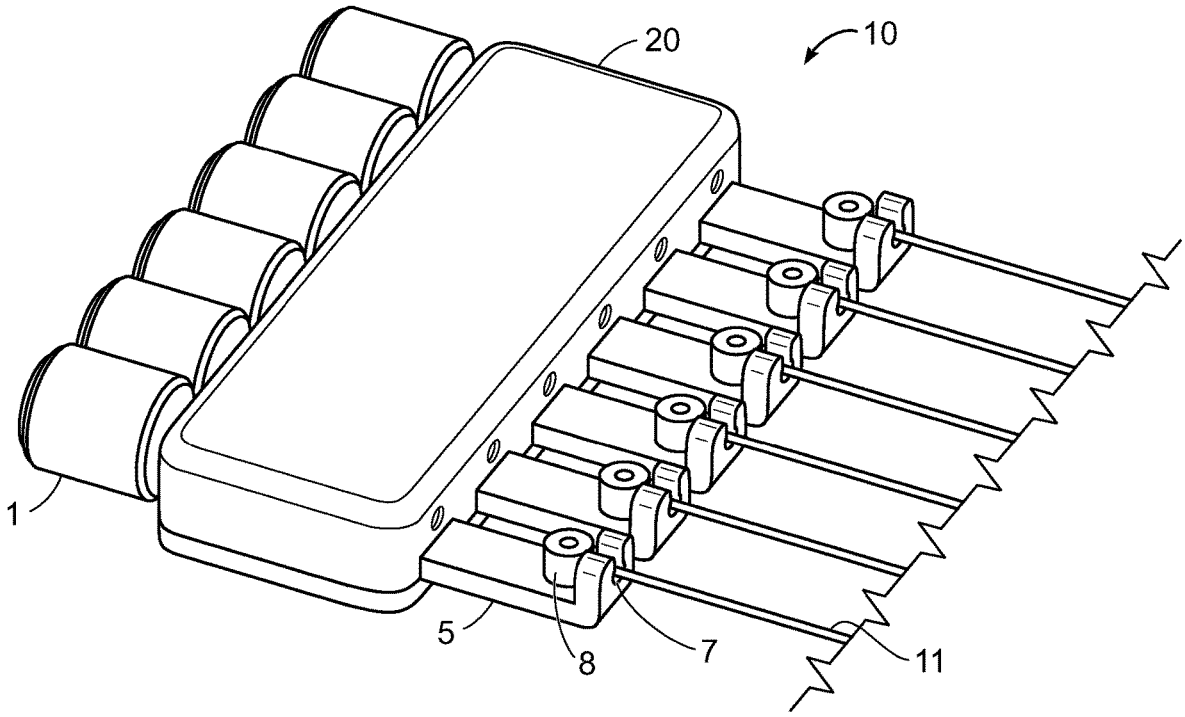
FIG. 1 is a perspective view of the tuner shown with strings attached.

In FIG. 1 is a perspective view of the tuner 10 shown with strings 11 attached. Tuning knobs 1 extends from the rear of the tuner 10 and string holders 5 extend from the front of the tuner 10. The use of the terms front and rear are exemplary and only in reference to the drawings. Any directions used herein are for clarity only and are not intended to limit the scope of the disclosure. The string holders 5 can be configured, in some embodiments, to hold the ball end 8 of a string 11 in a slot 7. In some embodiments, the string holders 5 comprise an elongate portion, where the distal end from the tuner body 20 further comprises the slot 7.

Figure 2:
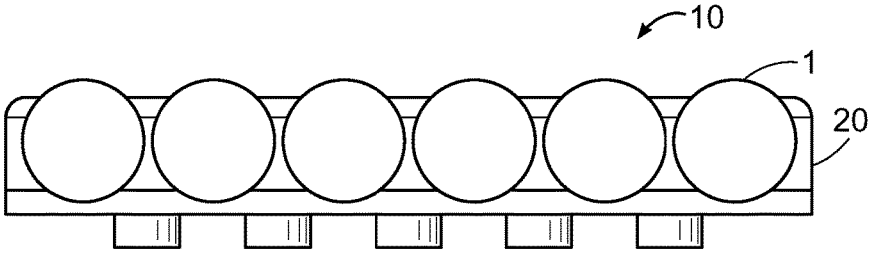
FIG. 2 is a rear view of the tuner.
Figure 3:
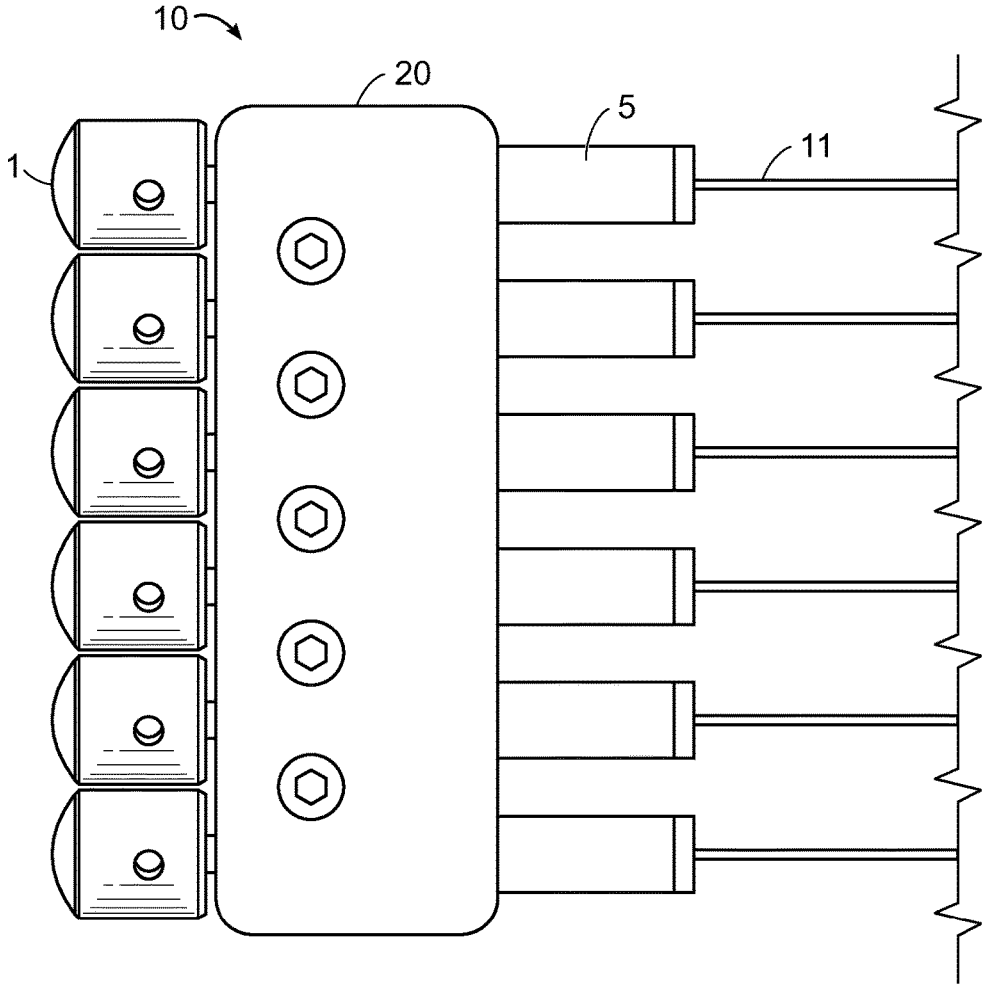
FIG. 3 is a bottom view of the tuner.
Figure 4:
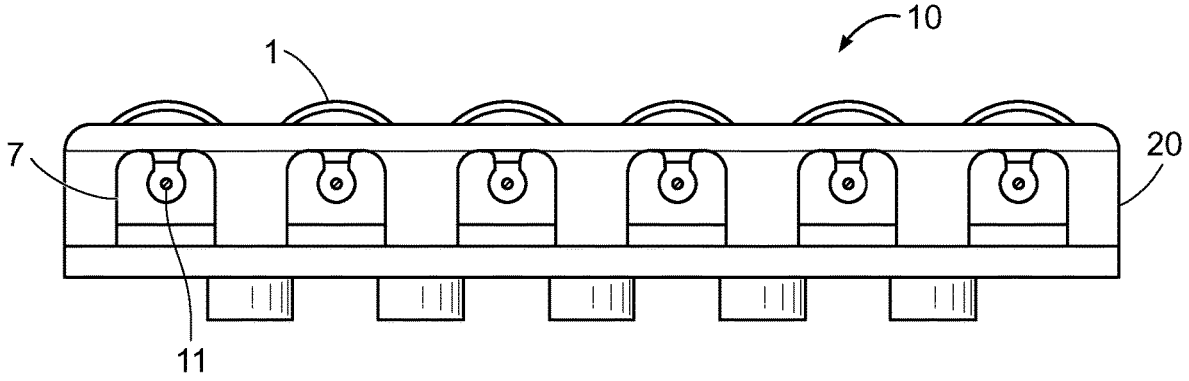
FIG. 4 is a front view of the tuner.
Figure 5:
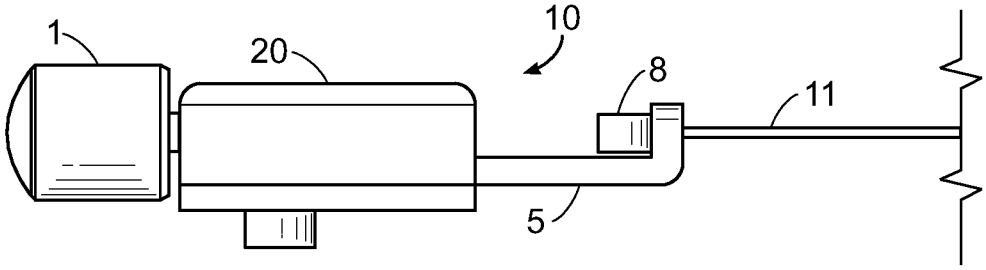
FIG. 5 is a right-side view of the tuner where the left-side is a mirror image.
Figure 6:
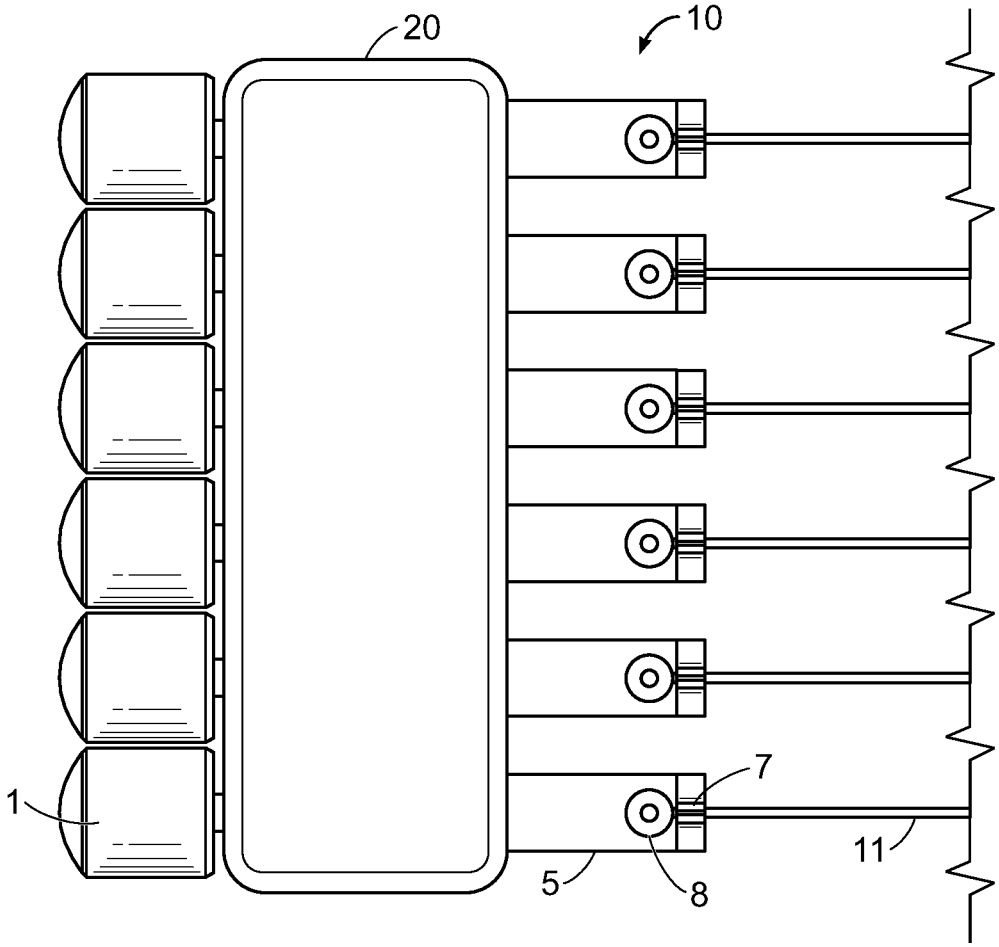
FIG. 6 is top view of the tuner.

In FIG. 2 is a rear view of the tuner 10 showing the tuning knobs 1 extending from the body 20. In FIG. 3 is a bottom view of the tuner 10 showing the configuration of the body 20 relative to the tuning knobs 1, the string holders 5 and the strings 11. FIGS. 4-6 are additional exterior views of the tuner 10 showing the configuration of the body 20 relative to the string holders 5 and strings 11 and the tuning knobs 1.

Figure 7:
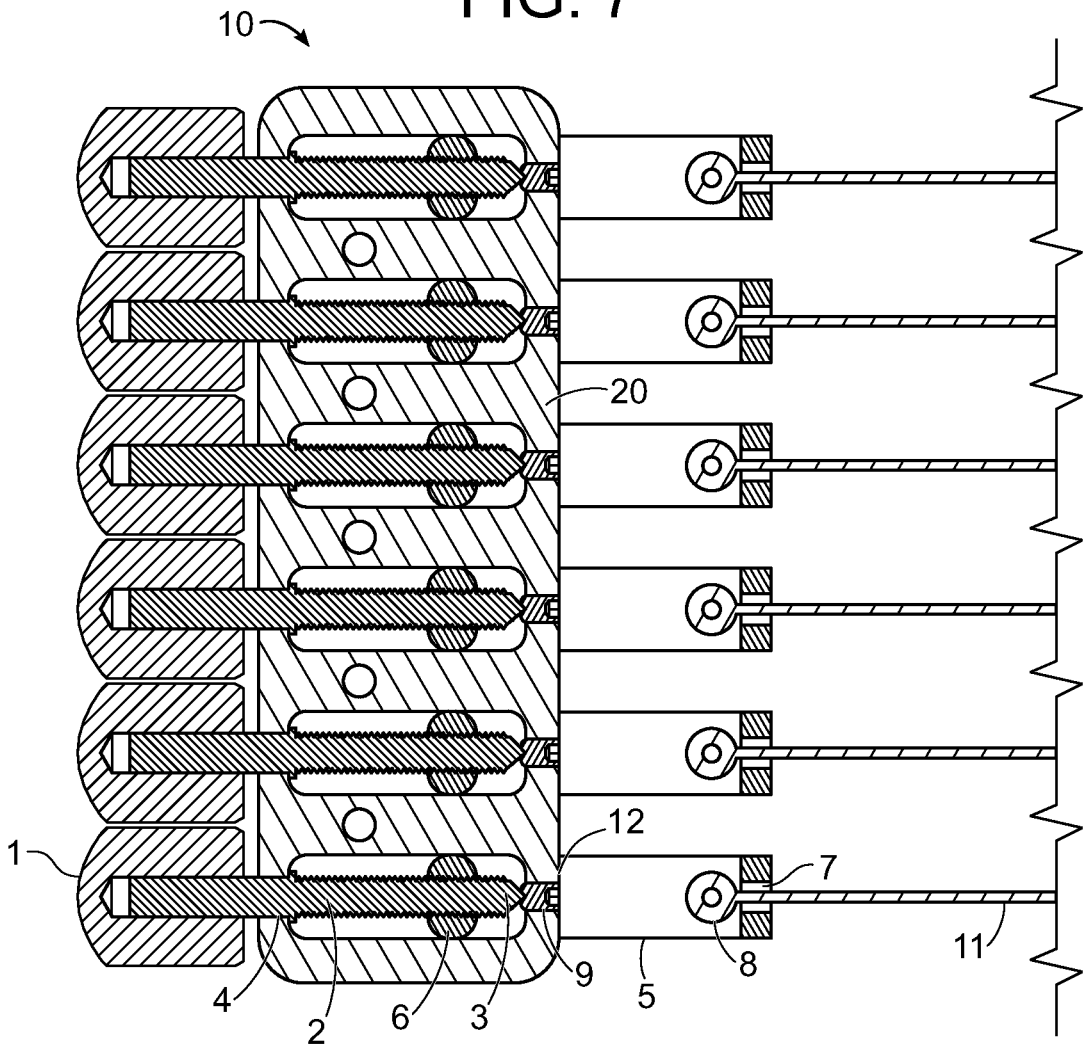
FIG. 7 is a top sectioned view of the tuner shown where the tuner was sectioned parallel to the bottom through the centers of each tuning knob, tuning screw and point bearing assembly.
Figure 8:
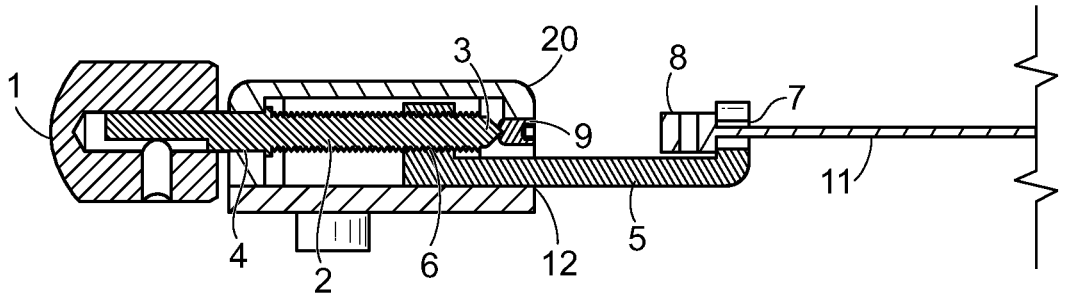
FIG. 8 is a side sectioned view of the tuner shown where the tuner was sectioned perpendicular to the bottom through the center of one tuning knob, tuning screw and point bearing assembly.

In FIG. 7 is a is a top sectioned view of the tuner 10 shown where the tuner 10 was sectioned parallel to the bottom through the centers of each tuning knob 1, tuning screw 2 and point bearing assembly 9. The tuning screw 2 is ground to a point 3 on one end with a tuning knob 1 fixed to the opposite end. The tuning screw 2 is inserted through a hole 4 in the back of the body 20 and threaded into a string holder 5. The string holders 5 can have a long notch cut from the top so that it is U-shaped from the side view and can slide though a clearance notch 12 in the housing. On one end of the string holder 5 is a threaded portion 6 to accept the tuning screw 2. A small slot 7 can be cut on the opposite end of the string holder 5 to accept the string 11 and retain the ball end 8. The tip of the tuning screw 3 is held from sliding by a cup shaped bearing 9 that is mounted towards front of the body 20. In some embodiments, the bearing 9 comprises external threads so the lateral position of the tuning screw 1 can be adjusted.

As the tuning knob 1 is turned, tension is applied to the string 11 and this tension force is transferred to the area between the tip of the tuning screw 3 and the bearing 9 rather than the area between the shoulder of the tuning knob 1 and the housing 20. Due to the low rotational friction of a point bearing, the tuning knob 1 is relatively easy to turn compared to conventional tuners.

The present disclosure includes a tuner for use on a stringed musical instrument, which comprises a body comprising a bearing carrier fixed to an internal surface of the body; a tuning screw opening in the body opposite the bearing carrier; a slider opening in the body on the same side as the bearing carrier; a tuning screw with a first end and a second end, wherein the second end comprises a conical surface profile; wherein the tuning screw comprises a helical protrusion towards the second end; wherein the bearing carrier comprises a concave profile facing the tuning screw opening; wherein the tuning screw is slidably attached to the body through the tuning screw opening and the second end of the tuning screw slidably contacts the bearing carrier; a slider comprising a first end disposed on one side of the bearing carrier and a second end disposed on the opposite end of the bearing carrier; wherein the first end of the slider comprises a helical passageway configured to interface the helical protrusion of the tuning screw; and wherein the second end of the slider comprises a means for attaching a string. In some embodiments of the tuner, the slider further comprises a u-shaped profile in a direction. In some embodiments of the tuner, the slider comprises a u-shaped profile from a lateral direction relative to the body. In some embodiments of the tuner, the interface between the helical passageway and the helical protrusion are configured to cause movement of the slider relative to the body. In some embodiments of the tuner, the second end of the tuning screw further comprises a truncated conical profile. In some embodiments of the tuner, the slider is configured to freely slide through the slider opening in the body. In some embodiments of the tuner, the slider opening further comprises a location below the bearing carrier when the body is viewed in an upright direction. In some embodiments of the tuner, the means for attaching a string further comprises a slot configured to capture the ball end of a string. Some embodiments of the tuner further comprise a knob fixed to the tuning screw, wherein the knob is located outside of the body and does not contact the body. In some embodiments of the tuner, the bearing carrier further comprises a threaded outer surface and wherein the body comprises an opening with a correspondingly threaded opening configured to allow the threads of the bearing carrier to engage the threads of the body. In some embodiments of the tuner, the bearing carrier is further configured to allow adjustment in the direction from the bearing carrier to the tuning screw opening.

What has been described is a low friction tuner for use on a stringed musical instrument. In this disclosure, there is shown and described only the preferred embodiment of the invention, but, as aforementioned, it is to be understood that the invention is capable of use in various other combinations and environments and is capable of changes or modifications within the scope of the inventive concept as expressed herein.

What is claimed is:

1. A tuner for use on a stringed musical instrument, which comprises:

a body comprising a bearing carrier fixed to an internal surface of the body;

a tuning screw opening in the body opposite the bearing carrier;

a slider opening in the body on the same side as the bearing carrier;

a tuning screw with a first end and a second end, wherein the second end comprises a conical surface profile;

wherein the tuning screw comprises a helical protrusion towards the second end;

wherein the bearing carrier comprises a concave profile facing the tuning screw opening;

wherein the tuning screw is slidably attached to the body through the tuning screw opening and the second end of the tuning screw slidably contacts the bearing carrier;

a slider comprising a first end disposed on one side of the bearing carrier and a second end disposed on the opposite end of the bearing carrier;

wherein the first end of the slider comprises a helical passageway configured to interface the helical protrusion of the tuning screw; and wherein the second end of the slider comprises a means for attaching a string.

2. The tuner of claim 1, wherein the slider further comprises a u-shaped profile in a direction.

3. The tuner of claim 2, wherein the slider comprises a u-shaped profile from a lateral direction relative to the body.

4. The tuner of claim 1, wherein the interface between the helical passageway and the helical protrusion are configured to cause movement of the slider relative to the body.

5. The tuner of claim 1, wherein the second end of the tuning screw further comprises a truncated conical profile.

6. The tuner of claim 1, wherein the slider is configured to freely slide through the slider opening in the body.

7. The tuner of claim 6, wherein the slider opening further comprises a location below the bearing carrier when the body is viewed in an upright direction.

8. The tuner of claim 1, wherein the means for attaching a string further comprises a slot configured to capture the ball end of a string.

9. The tuner of claim 1, further comprising a knob fixed to the tuning screw, wherein the knob is located outside of the body and does not contact the body.

10. The tuner of claim 1, wherein the bearing carrier further comprises a threaded outer surface and wherein the body comprises an opening with a correspondingly threaded opening configured to allow the threads of the bearing carrier to engage the threads of the body.

11. The tuner of claim 10, wherein the bearing carrier is further configured to allow adjustment in the direction from the bearing carrier to the tuning screw opening.

* * * * *